United States Patent [19]

Whitney

[11] 4,390,050

[45] Jun. 28, 1983

[54] TACK PLIERS

[76] Inventor: LeRoy E. Whitney, Rt. 2, Box 590, Newcastle, Wyo. 82701

[21] Appl. No.: 290,158

[22] Filed: Aug. 5, 1981

[51] Int. Cl.[3] ..... B25C 3/00

[52] U.S. Cl. ..... 145/46

[58] Field of Search ..... 145/46

[56] References Cited

U.S. PATENT DOCUMENTS

| | | | |
|---|---|---|---|
| 219,504 | 9/1879 | Obrist | 145/46 |
| 371,105 | 10/1887 | Souders | 145/46 |
| 682,681 | 9/1901 | Haas | 145/46 |
| 1,062,464 | 5/1913 | Haynes | 145/46 |
| 3,111,750 | 11/1963 | Moore et al. | 145/46 |

FOREIGN PATENT DOCUMENTS

| | | | |
|---|---|---|---|
| 105784 | 9/1899 | Fed. Rep. of Germany | 145/46 |
| 221265 | 5/1962 | Fed. Rep. of Germany | 145/46 |
| 1257621 | 2/1961 | France | 145/46 |
| 60590 | 5/1912 | Switzerland | 145/46 |
| 231754 | 8/1944 | Switzerland | 145/46 |

*Primary Examiner*—James L. Jones, Jr.
*Assistant Examiner*—J. T. Zatarga
*Attorney, Agent, or Firm*—Richard L. Miller

[57] ABSTRACT

A pair of pliers designed to grasp a short nail or tack and support the same while being pounded into a work by a hammer; the pliers including a pair of jaws between which the tack is held and extends outwardly from one end thereof, while the hammer is struck against the opposite end of the jaws.

1 Claim, 4 Drawing Figures

Fig. 1
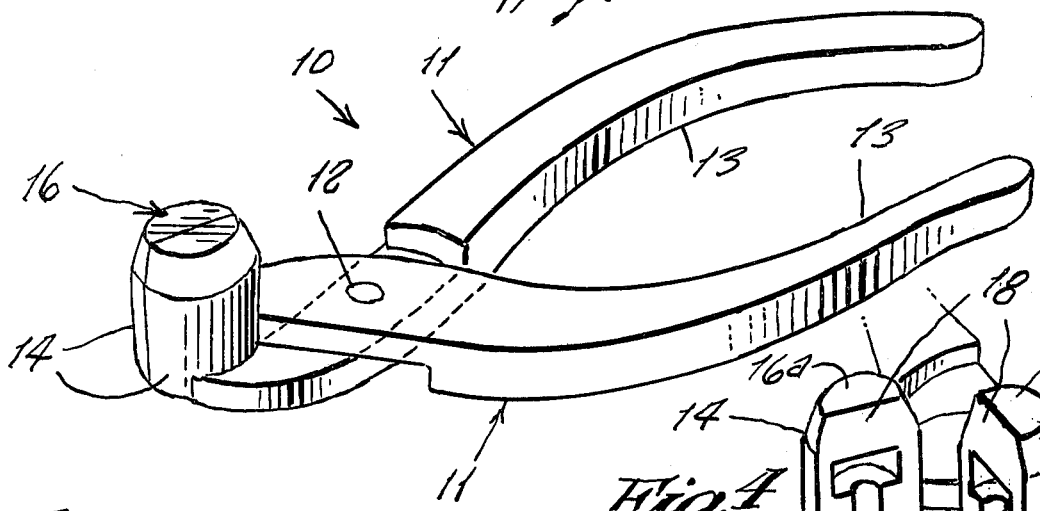
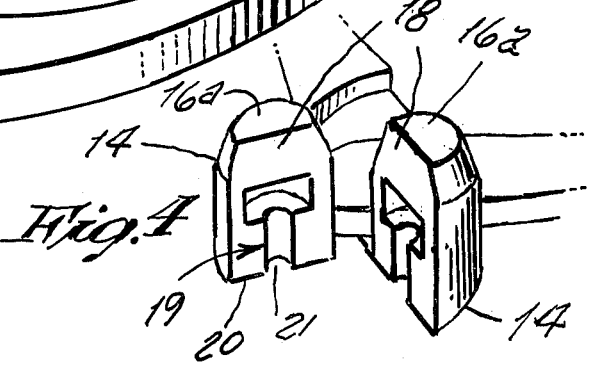
Fig. 4
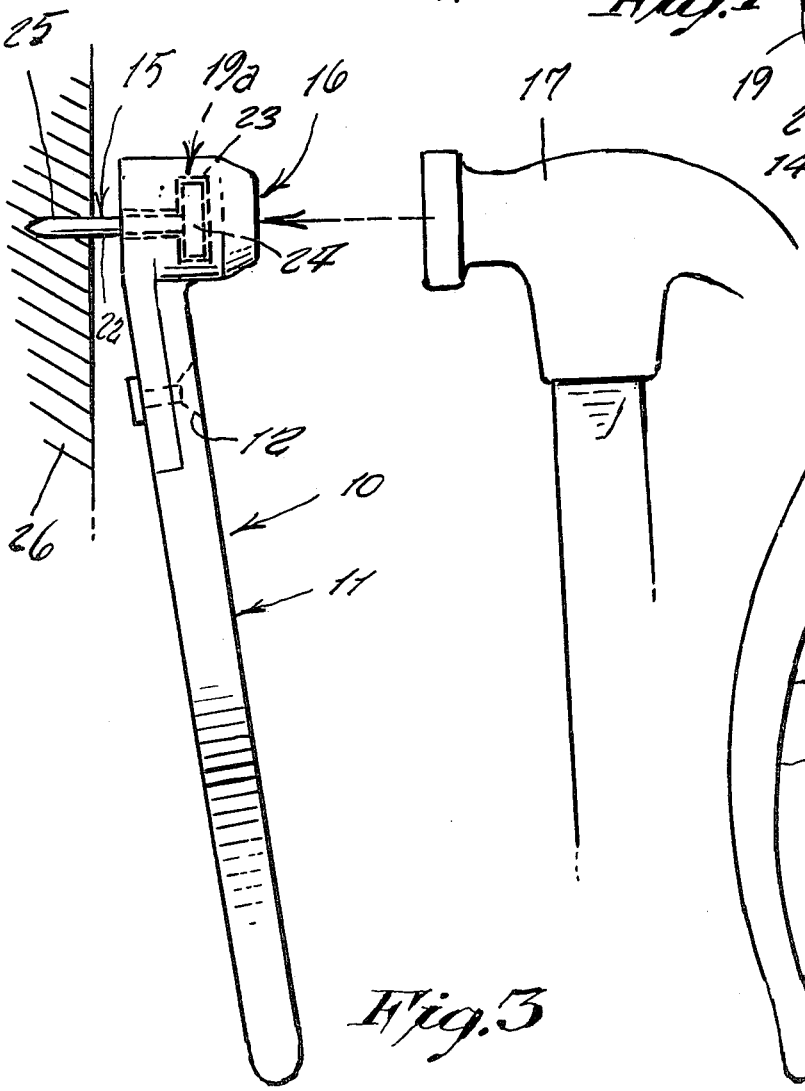
Fig. 3
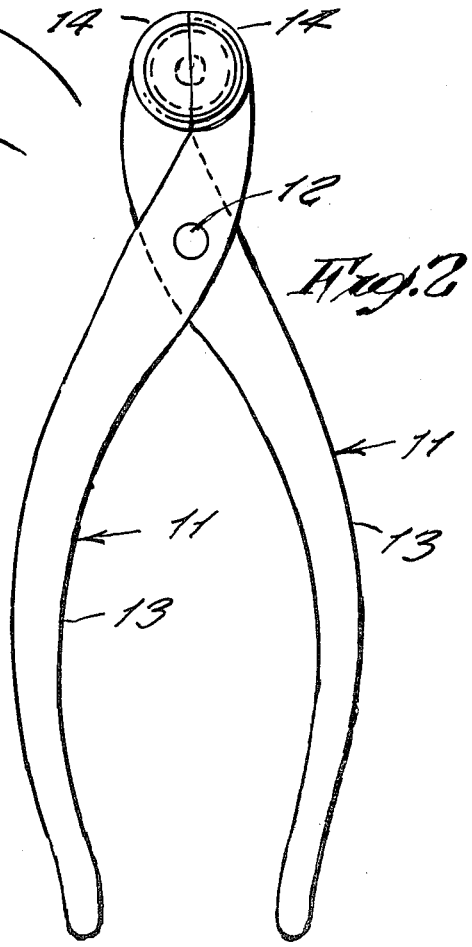
Fig. 2

TACK PLIERS

This invention relates generally to devices used to support a nail or the like, while it is being driven.

BACKGROUND OF THE INVENTION

It is well known that often when driving a nail it must be steadied while being pounded into place by means of a hammer. To hold the nail between a person's fingers can be dangerous, because the hammer may possibly strike the fingers. This is especially so when the nail is short, such as a tack, so that the fingers are very close to the nail head being struck by the hammer. If the nail is long it may possibly be supported between the jaws of a conventional pliers, so as to keep the fingers out of the way, however when the nail is short or comprises a tack, then no conventional tool can aid in its support, so that this situation is accordingly in need of an improvement.

SUMMARY OF THE INVENTION

Therefore it is a principal object of the present invention to provide a tack pliers which is able to support a short nail or tack while it is being driven.

Another object is to provide a tack pliers which includes a pair of jaws that may be directly struck on their end by the hammer while holding the tack, so that the tack may be even shorter in length than the thickness of the jaws, and does not require being struck by the hammer directly on the tack's head.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The figures on the drawings are briefly described as follows:

FIG. 1 is a perspective view of the invention, shown with jaws closed.

FIG. 2 is a plan view thereof.

FIG. 3 is a side view thereof shown in use.

FIG. 4 is a perspective view of the jaws shown spread open.

DETAILED DESCRIPTION OF THE PREFERRED EMBODIMENT

Referring now to the drawing in greater detail, the reference numeral 10 represents a tack pliers, according to the present invention, wherein there are a pair of crossing levers 11 pivoted at their longitudinally intermediate point about a common rivet 12, so that one end of the levers form co-operative handles 13 for being held in a hand and the other end comprises a pair of co-operative jaws 14 between which a tack 15 may be grasped while being driven.

Each jaw is generally semi-cylindrically shaped, so that when placed together they form a generally cylindrical assembly which includes on flat end wall 16 against which a hammer 17 may be struck.

Each jaw accordingly includes a semi-circular end wall **16*a* which when adjacent each other form the assembled, flat end wall 16. Each jaw also includes a diametrically extending flat wall 18** which abut each other when the jaws are in a closed position.

In the present invention, a semi-cylindrical blind hole 19 extends axially in each jaw, so that when the jaws are closed together the two semi-cylindrical holes 19 thus together form a single, cylindrical, blind hole **19*a* in which the tack is held. Each hole 19 extends from an end wall 20, which is opposite to the end wall 16 struck by the hammer. Each hole 19 includes a narrow semi-cylindrical portion 21 through which the shank 22 of the tack extends, and it also includes a wide relatively thin, semi-cylindrical portion 23 in which a wide diameter tack head 24** may be seated.

In operative use, it is now evident, that when the jaws are spread apart, as shown in FIG. 4, a tack may be seated inside the hole **19*a* and the jaws then closed, so that only the pointed end 25 of the tack protrudes outwardly, and is then placed against a spot on a work 26 into which the tack is intended to be driven. The hammer then strikes the closed jaws, as shown in FIG. 3**, driving the tack into the work. When the tack is sufficiently supported in the work, the plier is removed, and the hammer then continues to drive the tack to a desired depth in the work.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

I claim:

1. A tack pliers, comprising: an elongated pair of crossing levers; a rivet located at the crossing point of said levers and forming a pivot therebetween; cooperative handles formed at one end of said levers, and cooperating jaws formed at the other end of said levers, each jaw comprising a semicylindrical body member, a flat top surface, a parallel flat bottom surface, and a flat diametric surface interconnecting said top and bottom surfaces and substantially perpendicular thereto, a first semicylindrical hole coaxial with said body member formed into said diametric surface at a location between said bottom and top surfaces, a second semicylindrical hole coaxial with said body member formed into said diametric surface commencing at said bottom surface and terminating into said first semicylindrical hole, said second semicylindrical hole being smaller than said first semicylindrical hole, both said jaws being substantially identical such that once said diametric surfaces are brought into abutting relationship a generally cylindrical assembly is formed, said second cylindrical holes mating to form a cylindrical aperture for receiving the shank portion of a nail, said first semicylindrical holes mating to form a cylindrical groove for receiving the head portion of a nail, said top surfaces meeting to form a coplanar end wall which can be struck by a hammer, said bottom surfaces meeting to form a coplanar lower wall, said jaws being substantially short with respect to the length of said levers, the axis of said formed cylindrical assembly being substantially perpendicular to said levers, and wherein said handles bend away from the plane of said lower wall.

* * * * *